US008272232B2

(12) United States Patent
Kim et al.

(10) Patent No.: US 8,272,232 B2
(45) **Date of Patent: *Sep. 25, 2012**

(54) REFRIGERATOR

(75) Inventors: Dae-Yeon Kim, Busan (KR); Seung-Jin Choi, Gimhae-shi (KR)

(73) Assignee: LG Electronics Inc., Seoul (KR)

( * ) Notice: Subject to any disclaimer, the term of this patent is extended or adjusted under 35 U.S.C. 154(b) by 748 days.

This patent is subject to a terminal disclaimer.

(21) Appl. No.: 12/440,443

(22) PCT Filed: Mar. 9, 2007

(86) PCT No.: PCT/KR2007/004240

§ 371 (c)(1),
(2), (4) Date: Mar. 6, 2009

(87) PCT Pub. No.: WO2008/030020

PCT Pub. Date: Mar. 13, 2008

(65) Prior Publication Data

US 2010/0192614 A1 Aug. 5, 2010

(30) Foreign Application Priority Data

Sep. 6, 2006 (KR) ..... 10-2006-0085839
Feb. 23, 2007 (KR) ..... 10-2007-0018597

(51) Int. Cl.
*F25C 5/18* (2006.01)
*F25D 23/12* (2006.01)
*F25D 25/00* (2006.01)

(52) U.S. Cl. ..... 62/344; 62/338; 62/377

(58) Field of Classification Search ..... 62/344, 62/340, 338, 347, 377, 389, 449; 220/797
See application file for complete search history.

(56) References Cited

U.S. PATENT DOCUMENTS

| | | | | |
|---|---|---|---|---|
| 2,349,665 | A | 5/1944 | Levit | |
| 5,012,655 | A * | 5/1991 | Chatterton | 62/340 |
| 5,683,015 | A | 11/1997 | Lee | |
| 5,857,596 | A * | 1/1999 | Lee | 222/509 |
| 5,904,054 | A | 5/1999 | Lee | |
| 2008/0041089 | A1 * | 2/2008 | Choi et al. | 62/344 |

FOREIGN PATENT DOCUMENTS

| | | | |
|---|---|---|---|
| CN | 2122356 | U | 11/1992 |
| CN | 1170129 | A | 1/1998 |
| GB | 2 271 838 | A | 4/1994 |
| JP | 6-11228 | A | 1/1994 |
| JP | 11304323 | A | 11/1999 |
| WO | WO-2005/010447 | A1 | 2/2005 |
| WO | WO-2005/026631 | A1 | 3/2005 |
| WO | WO 2005026631 | A1 * | 3/2005 |

* cited by examiner

*Primary Examiner* — Chen Wen Jiang
(74) *Attorney, Agent, or Firm* — Birch, Stewart, Kolasch & Birch, LLP

(57) ABSTRACT

The present invention discloses a refrigerator with a water tank for supplying water to an ice tray by closing of a door. A refrigerator includes a cooling chamber for storing an article at a low temperature, an ice tray positioned in the cooling chamber and filled with water, for making ice, a water tank with a water supply hole for storing water and supplying water to the ice tray, and a valve for selectively opening and closing the water supply hole. In addition, a refrigerator includes a cooling chamber for storing an article at a low temperature, a main body for defining the cooling chamber, a door for opening and closing the cooling chamber, an ice tray positioned inside the door and filled with water, for making ice, a water tank with a water supply hole for storing water and supplying water to the ice tray, and a valve for selectively opening and closing the water supply hole.

28 Claims, 8 Drawing Sheets

- Prior Art -

REFRIGERATOR

TECHNICAL FIELD

The present invention relates to an ice tray assembly for a refrigerator and a refrigerator having the same, and more particularly, to an ice tray assembly for a refrigerator and a refrigerator having the same which can supply water in cooperation with closing of a refrigerator door.

BACKGROUND ART

FIG. 1 is a view illustrating a conventional ice tray assembly for a refrigerator. The conventional ice tray assembly for the refrigerator includes a casing 10 installed in the refrigerator, and an ice tray 20 placed in the casing 10, for making ices. A shelf 12 on which the ice tray 20 is put is formed in the casing 10. A user fills the ice tray 20 with water and puts the ice tray 20 into the casing 10, so that the ices are made in the ice tray 20 by cool air flowing in the refrigerator.

However, in the conventional ice tray assembly for the refrigerator, when the casing 10 with the ice tray 20 mounted therein is installed in a freezing chamber for freezing food, the casing 10 occupies a large area of a freezing space in the freezing chamber. In the case that the casing 10 is installed at a door for opening and closing the freezing chamber, when the door is closed, water filled in the ice tray 20 may overflow out of the casing 10.

Moreover, as a valve is driven in a state where a water tank is not completely mounted in the freezing chamber, some of water stored in the water tank may not be supplied to the ice tray 20 but dispersed into the freezing chamber.

DISCLOSURE OF THE INVENTION

An object of the present invention is to provide a refrigerator which can minimize contamination of ices in an ice making process.

Another object of the present invention is to provide a refrigerator which can prevent water from overflowing from an ice tray by closing of a door.

Yet another object of the present invention is to provide a refrigerator having a water tank for supplying water to an ice tray by closing of a door.

Yet another object of the present invention is to provide a refrigerator having an ice tray assembly which can secure a food storage space by minimizing an installation space of the ice tray assembly.

In order to achieve the above-described objects of the invention, there is provided a refrigerator, including: a cooling chamber for storing an article at a low temperature; an ice tray positioned in the cooling chamber and filled with water, for making ice; a water tank with a water supply hole for storing water and supplying water to the ice tray; and a valve for selectively opening and closing the water supply hole.

In another aspect of the present invention, the refrigerator further includes an operation member for opening the valve.

In yet another aspect of the present invention, the operation member is a valve driving button.

In yet another aspect of the present invention, the water supply hole is positioned at the lower portion of the water tank, and the valve is installed to be movable in the up-down direction through the water supply hole. The refrigerator further includes a first elastic member for applying force to move the valve to the lower part to shield the water supply hole.

In yet another aspect of the present invention, the valve driving button is positioned at the front of the water tank, and pressed to the rear of the water tank, for moving the valve to the upper part to open the water supply hole. The refrigerator further includes a second elastic member for applying force to move the valve driving button to the front.

In yet another aspect of the present invention, the refrigerator further includes a cover for selectively opening and closing the water tank.

In yet another aspect of the present invention, the water tank is partitioned off into a plurality of water storage spaces, and a plurality of water supply holes are formed at the plurality of water storage spaces, respectively, for supplying water to the ice tray.

In yet another aspect of the present invention, the valve includes: a valve main body provided at the lower portion of the water tank; at least one cap fixing protrusion coupled to the valve main body to pass through the water supply hole; and a valve cap being provided at the leading end of the cap fixing protrusion and having a wider area than the water supply hole.

In yet another aspect of the present invention, the water tank further includes a valve guide boss at the bottom face thereof, and the valve further includes a supporting protrusion inserted into the valve guide boss to move along the valve guide boss in the up-down direction.

In yet another aspect of the present invention, the refrigerator further includes a first elastic member for applying an elastic force to move the valve to the lower part to shield the water supply hole.

In yet another aspect of the present invention, both ends of the elastic member are supported by the bottom face of the water tank and the valve main body, respectively.

In yet another aspect of the present invention, the water tank includes a button guide portion at the bottom face thereof, and the valve driving button includes an operation portion positioned at the front of the water tank to be retreatable, a driving portion positioned at the rear end of the operation portion and closely adhered to the bottom face of the valve, and a guide bar provided at the rear end of the driving portion to be movable in the forward-backward direction through the button guide portion.

In yet another aspect of the present invention, the refrigerator further includes a second elastic member for applying an elastic force to move the valve driving button to the front to shield the water supply hole.

In yet another aspect of the present invention, both ends of the second elastic member are supported by one side of the valve driving button and one side of the button guide portion, respectively.

In yet another aspect of the present invention, the refrigerator includes a main body for defining the cooling chamber, and a door for opening and closing the cooling chamber, wherein the ice tray and the water tank are positioned in the main body, and the valve driving button is pressed to open the valve by closing of the door.

In yet another aspect of the present invention, the refrigerator includes a main body for defining the cooling chamber, and a door for opening and closing the cooling chamber, wherein the operation member opens the valve in cooperation with closing of the door.

In yet another aspect of the present invention, the operation member is a dike for opening and closing the valve.

In yet another aspect of the present invention, the refrigerator includes a lever for mediating the operations of the operation member and the valve.

In yet another aspect of the present invention, the refrigerator further includes an operation member positioned in the main body, for opening the valve in cooperation with closing of the door.

In yet another aspect of the present invention, the valve includes: a head positioned at the water supply hole, for opening and closing the water supply hole; a stem extending from the head and cooperating with the operation member; and an elastic member for applying an elastic force to the stem.

In yet another aspect of the present invention, the refrigerator further includes an ice bank positioned at the lower portion of the ice tray, and taken in and out of the cooling chamber, for storing the ice made in the ice tray.

In yet another aspect of the present invention, the refrigerator further includes an ice bank installed at the door, and positioned at the lower portion of the ice tray in closing of the door, for storing the ice made in the ice tray.

In yet another aspect of the present invention, the ice bank is detachably installed at the door.

In addition, there is provided a refrigerator, including: a cooling chamber for storing an article at a low temperature; a main body for defining the cooling chamber; a door for opening and closing the cooling chamber; an ice tray positioned inside the door and filled with water, for making ice; a water tank with a water supply hole for storing water and supplying water to the ice tray; and a valve for selectively opening and closing the water supply hole.

In another aspect of the present invention, the refrigerator further includes an operation member for opening the valve in cooperation with closing of the door.

In yet another aspect of the present invention, the operation member is a dike provided on the side of the storage chamber, for opening the valve.

In yet another aspect of the present invention, the refrigerator includes a lever for mediating the operations of the operation member and the valve.

In yet another aspect of the present invention, the valve includes: a head positioned at the water supply hole, for opening and closing the water supply hole; a stem extending from the head and cooperating with the operation member; and an elastic member for applying an elastic force to the stem.

In yet another aspect of the present invention, the refrigerator further includes an ice bank positioned at the lower portion of the ice tray in closing of the door, and taken in and out of the cooling chamber, for storing the ice made in the ice tray.

In yet another aspect of the present invention, the ice bank is installed at the door.

In yet another aspect of the present invention, the ice bank is detachable from the door.

ADVANTAGEOUS EFFECTS

According to the refrigerator of the present invention, in a state where the water tank is mounted in the freezing chamber, the valve driving button is operated to drive the valve, so that water stored in the water tank is supplied to the ice tray. In the prior art, while the water tank is mounted in the freezing chamber, the valve may be driven, so that water stored in the water tank disperses into the freezing chamber and contaminates the freezing chamber. According to the present invention, the refrigerator overcomes such a problem and improves cleanliness.

According to the refrigerator of the present invention, the ice tray assembly can be installed at the door to prevent water from overflowing by closing of the door.

According to the refrigerator of the present invention, water can be supplied by closing of the door.

According to the refrigerator of the present invention, the installation space of the ice tray assembly can be minimized to secure the food storage space.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

A refrigerator in accordance with preferred embodiments of the present invention will be described in detail with reference to the accompanying drawings.

Figure 1:
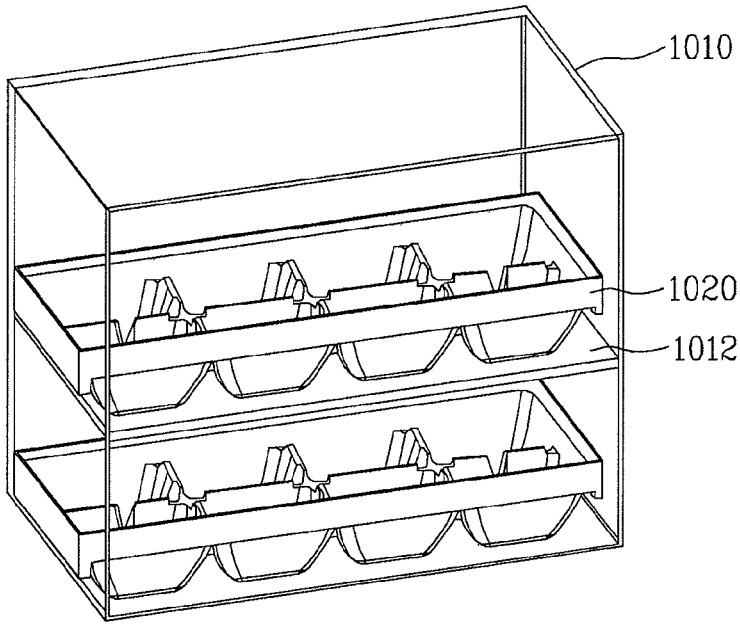
FIG. 1 is a view illustrating a conventional ice tray assembly for a refrigerator.
Figure 2:
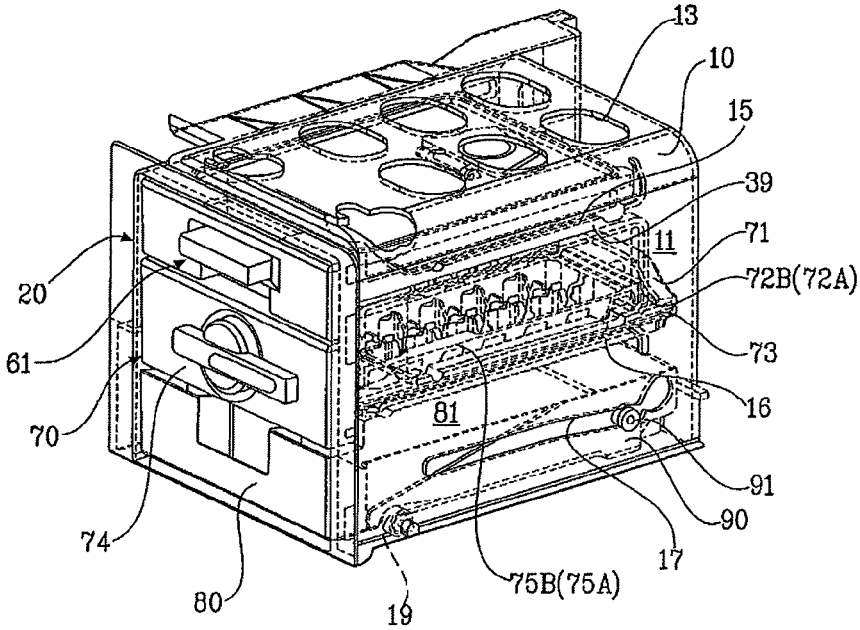
FIG. 2 is a see-through view illustrating an ice making device provided in a refrigerator according to a preferred embodiment of the present invention.
Figure 3:
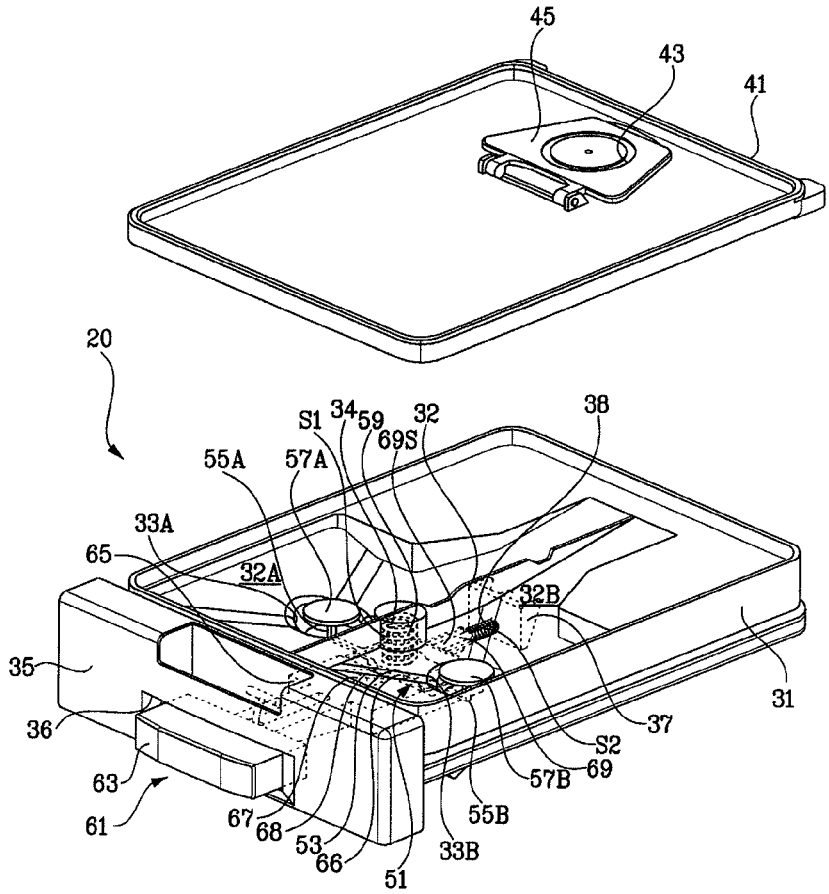
FIG. 3 is a see-through view illustrating major parts of a water tank constituting the embodiment of FIG. 2.
Figure 4:
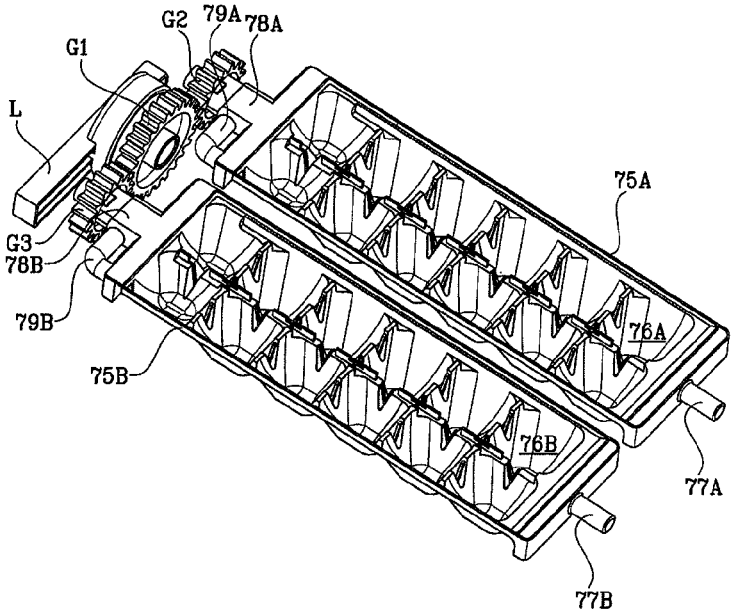
FIG. 4 is a view illustrating major parts of an ice making unit constituting the embodiment of FIG. 2.

FIG. 2 is a see-through view illustrating an ice making device provided in a refrigerator according to a preferred embodiment of the present invention, FIG. 3 is a see-through view illustrating major parts of a water tank constituting the embodiment of FIG. 2, and FIG. 4 is a view illustrating major parts of an ice making unit constituting the embodiment of FIG. 2.

Referring to FIG. 2, an ice making housing 10 constituting the ice making device is formed in a hexahedral shape with open front and rear faces. The ice making housing 10 is detachably installed in a freezing chamber of the refrigerator. An ice making space 11 is defined in the ice making housing 10 so that a water tank 20, an ice making unit 70, an ice bank 80 and a guide plate 90 explained later can be installed therein.

Meanwhile, a plurality of cool air supply holes 13 are formed at the top face of the ice making housing 10. The cool air supply holes 13 are formed by cutting the top face of the ice making housing 10 in an almost elliptical shape, and serve to guide the cool air circulating in the freezing chamber to the ice making space 11.

A pair of guide grooves 15 and 16 are formed at both inner sides of the ice making housing 10. The guide grooves 15 and 16 are formed at both sides of the ice making housing 10 with the corresponding heights to be long in the forward-backward direction. The guide grooves 15 and 16 serve to guide the water tank 20 and the ice making unit 70 taken in and out of the ice making space 11. The guide grooves 15 and 16 are provided at both inner sides of the ice making housing 10 corresponding to the upper and center portions of the ice making space 11, respectively. Hereinafter, the guide grooves positioned at the upper portion of the ice making space 11 are referred to as first guide grooves 15, and the guide grooves positioned at the center portion thereof are referred to as second guide grooves 16.

Guide slots 17 are formed at the bottom ends of both sides of the ice making housing 10, respectively. The guide slots 17 are formed by cutting the bottom ends of both sides of the ice making housing 10 to be long in the forward-backward direction, and serve to guide the ice bank 80 and the guide plate 90 taken in and out of the ice making space 11. The guide slots 17 are formed in a curved shape so that the front and rear ends thereof can downwardly incline to the front and the rear, respectively.

Guide rollers 19 are provided at the front bottom ends of both inner sides of the ice making housing 10. The guide rollers 19 serve to guide in and out of the ice bank 80 and the guide plate 90. The guide rollers 19 are rotatable around horizontal rotation axes.

In the meantime, the water tank 20 is detachably installed at the upper portion of the ice making space 11. The water tank 20 stores water for making ice. As shown in FIG. 3, the water tank 20 includes a tank main body 31, a cover 41, a valve 51 and a valve driving button 61.

The tank main body 31 is formed in a polyhedral shape with an open top face. A water storage space for storing water is defined in the tank main body 31. A partitioning rib 32 is provided at the center of the water storage space to be long in the forward-backward direction. The partitioning rib 32 partitions the water storage space into a first water storage space 32A and a second water storage space 32B. The first and second water storage spaces 32A and 32B store water required to make ices once in first and second ice trays 75A and 75B, respectively.

A pair of water supply holes, namely, a first water supply hole 33A and a second water supply hole 33B are formed at the tank main body 31. The first and second water supply holes 33A and 33B serve to supply water stored in the first and second water storage spaces 32A and 32B to the first and second ice trays 75A and 75B, respectively. To this end, the first and second water supply holes 33A and 33B are formed by opening parts of the bottom face of the tank main body 31 in the up-down direction to communicate with the first and second water storage spaces 32A and 32B, respectively. Here, the first and second water supply holes 33A and 33B are spaced apart from each other at a predetermined interval in the left-right direction to be symmetric around the partitioning rib 32.

A valve guide boss 34 is formed at the bottom face of the tank main body 31. The valve guide boss 34 is open to the lower part to guide the up-down movement of the valve 51. The valve guide boss 34 is formed by depressing a part of the bottom center portion of the tank main body 31 which is the direct lower portion of the partitioning rib 32 in the upward direction, namely, in the first and second water storage spaces 32A and 32B.

A button installation portion 35 is provided at the front face of the tank main body 31. The button installation portion 35 is more downwardly extended than the bottom face of the tank main body 31. A button installation opening 36 is formed at the button installation portion 35. The button installation opening 36 is formed by cutting the center bottom end of the button installation portion 35 to correspond to the vertical section of the valve driving button 61.

In addition, a button guide portion 37 is formed at the bottom face of the tank main body 31. The button guide portion 37 downwardly protrudes from the bottom center portion of the tank main body 31 corresponding to the rear of the valve guide boss 34. A button guide hole 38 is formed at the button guide portion 37. The button guide hole 38 serves to guide the forward-backward movement of the valve driving button 61.

Guide ribs 39 are provided at both outer sides of the tank main body 31, respectively, The guide ribs 39 of the tank main body 31 are inserted into the first guide grooves 15 of the ice making housing 10. When the water tank 20 is taken in and out, the guide ribs 39 slide along the first guide grooves 15.

The cover 41 serves to selectively open and close the first and second water storage spaces 32A and 32B. To this end, the cover 41 is formed in a rectangular shape to correspond to the cross-section of the tank main body 31, and detachably installed at the top end of the tank main body 31.

A water supply hole 43 is formed at one side of the cover 41. The water supply hole 43 is formed by cutting a part of the cover 41 to be spaced apart from the first and second water supply holes 33A and 33B by a predetermined distance in the lateral direction. Water supplied through the water supply hole 43 is stored in the first and second water storage spaces 32A and 32B. Alternatively, in a state where the cover 41 is disconnected from the tank main body 31, water can be supplied to the first and second water storage spaces 32A and 32B.

A water supply hole cover 45 for selectively opening and closing the water supply hole 43 is provided at the cover 41. The water supply hole cover 45 is installed so that one end can pivot around the other end in the up-down direction.

The valve 51 selectively opens and closes the first and second water supply holes 33A and 33B. The valve 51 includes a valve main body 52, cap fixing protrusions 55A and 55B, valve caps 57A and 57B, and a supporting protrusion 59.

Figure 5:
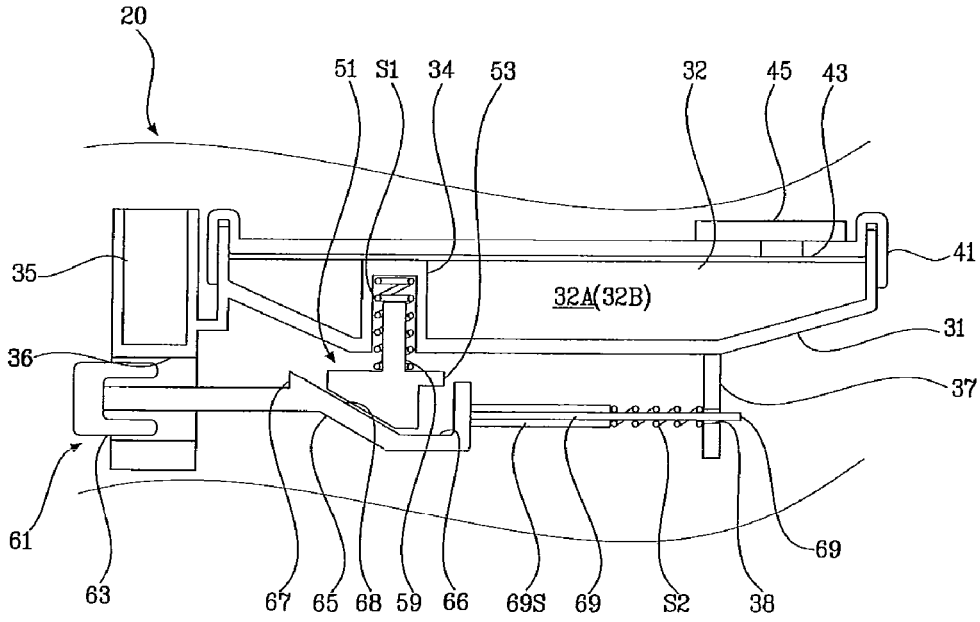
FIGS. 5 to 7 are operation state views illustrating a process of supplying water stored in the water tank constituting the preferred embodiment of the water tank for the refrigerator and the ice making device having the same according to the present invention.

The valve main body 52 has a predetermined length in the left-right direction. As illustrated in FIG. 5, a cooperation protrusion 53 is formed at the bottom face of the valve main body 52. The cooperation protrusion 53 moves the valve 51 to the upper part in cooperation with the valve driving button 61. Still referring to FIG. 5, the cooperation protrusion 53 is formed by downwardly protruding a part of the bottom face of the valve driving button 61. A cooperation guide face 54 is provided at the cooperation protrusion 53. The cooperation guide face 54 is formed by extending the bottom face of the cooperation protrusion 53 to be downwardly inclined to the rear.

The cap fixing protrusions 55A and 55B are formed at both ends of the valve main body 52. The cap fixing protrusions 55A and 55B are formed in an 'L' shape and passed through the first and second water supply holes 33A and 33B, so that the leading ends thereof are positioned in the first and second water storage spaces 32A and 32B, respectively.

The valve caps 57A and 57B are positioned at the leading ends of the cap fixing protrusions 55A and 55B positioned in the first and second water storage spaces 32A and 32B through the first and second water supply holes 33A and 33B, respectively. The valve caps 57A and 57B are formed in a predetermined shape and size to shield at least the first and second water supply holes 33A and 33B, and substantially selectively open and close the first and second water supply holes 33A and 33B.

The supporting protrusion 59 is provided at the top center portion of the valve main body 52. The supporting protrusion 39 is extended from the center of the valve main body 52 in the same direction as that of the cap fixing protrusions 55A and 55B, and inserted into the valve guide boss 34. In a state where the supporting protrusion 59 is inserted into the valve guide boss 34, it can move along the valve guide boss 34 in the up-down direction.

A first coil spring S1 is provided at the supporting protrusion 59. The first coil spring S1 applies an elastic force to the valve main body 52 so that the valve 51 can move in a direction of shielding the first and second water supply holes 33A and 33B by the valve caps 57A and 57B, namely, in the downward direction. To this end, both ends of the first coil spring S1 are supported by one side of the bottom face of the tank main body 31 inside the valve guide boss 34, and one side of the valve main body 52 adjacent to one end of the supporting protrusion 59, respectively.

The valve driving button 61 serves to drive the valve 51 to open and close the first and second water supply holes 33A and 33B. The valve driving button 61 is operated by a freezing chamber door D (refer to FIGS. 6 and 7) for selectively opening and closing the freezing chamber or a control of a user, for driving the valve 51. The valve driving button 61 includes an operation portion 63, a driving portion 65 and a guide bar 69.

The operation portion 63 is formed in a plate shape with a vertical section corresponding to the button installation opening 36. The operation portion 63 is installed to pass through the button installation opening 36. Accordingly, the front and rear ends of the operation portion 63 are positioned at the front and rear of the button installation portion 35. In this state, when the freezing chamber door D shields the freezing chamber, the front end of the operation portion 63 is pressed by the freezing chamber door D to move the valve driving button 61 to the rear.

The driving portion 65 extends from the rear end of the operation portion 63 to the rear by a predetermined length. The driving portion 65 is positioned so that the top face thereof can be closely adhered to the bottom face of the valve 51. A seating groove 66 is formed at the driving portion 65. As shown in FIG. 5, the seating groove 66 is formed by downwardly depressing a part of the driving portion 65. In a state where the first and second water supply holes 33A and 33B are shielded by the valve caps 57A and 57B, the cooperation protrusion 53 is seated at the seating groove 66. A driving protrusion 67 is provided at the top face of the driving portion 65. The driving protrusion 67 upwardly protrudes from the top face of the driving portion 65 by a predetermined height. A driving guide face 68 is provided at the top faces of the seating groove 66 and the driving protrusion 67 to match with the cooperation guide face 54. The driving guide face 68 is formed by extending the top faces of the seating groove 66 and the driving protrusion 67 to be downwardly inclined to the rear at a predetermined angle.

The guide bar 69 extends from the rear end of the driving portion 65 to the rear by a predetermined length. The guide bar 69 is formed in a bar shape with a vertical section corresponding to the button guide hole 38, and installed to pass through the button guide hole 38. When the operation portion 63 is pressed to the rear, the guide bar 69 passing through the button guide hole 38 moves to the rear.

A stopper 69S is provided at the guide bar 69. The stopper 69S is formed at the outer face of the guide bar 69 spaced apart by a predetermined distance from the rear end of the guide bar 69 to the rear end of the driving portion 65. The stopper 69S is provided in a plural number to radially extend from the outer circumference of the guide bar 69, thereby substantially increasing the diameter of the guide bar 69.

A second coil spring S2 is provided at the guide bar 69. The second coil spring S2 applies an elastic force to the valve main body 52 so that the valve driving button 61 can move in a direction of shielding the first and second water supply holes 33A and 33B by the valve caps 57A and 57B, namely, in the backward direction. To this end, both ends of the second coil spring S2 are supported by one face of the button guide portion 37 adjacent to the button guide hole 38 and one side of the stopper 69S, respectively.

The ice making unit 70 is detachably installed in the ice making space 11 below the water tank 20. The ice making unit 70 receives water stored in the water tank 20, substantially makes ices, separates the ices, and transfers the ices to the ice bank 80. The ice making unit 70 includes a supporting frame 71, first and second ice trays 75A and 75B, an operation lever L, and a plurality of gears G1, G2 and G3.

The supporting frame 71 is formed in a rectangular frame shape. The supporting frame 71 rotatably supports the first and second ice trays 75A and 75B, and is detachably installed in the ice making space 11.

A pair of tray stoppers 72A and 72B are provided inside the rear end of the supporting frame 71. The tray stoppers 72A and 72B support the first and second ice trays 75A and 75B in the horizontal level, and are closely adhered to one sides of the first and second ice trays 75A and 75B rotated at a predetermined angle, for twisting the first and second ice trays 75A and 75B.

Guide ribs 73 are formed outside both side ends of the supporting frame 71. In a state where the guide ribs 73 of the supporting frame 71 are inserted into the second guide grooves 16 of the ice making housing 10, the guide ribs 73 slide along the second guide grooves 16, for guiding connection and disconnection of the ice making unit 70.

Meanwhile, a gear box 74 is formed at the front end of the supporting frame 71. The gear box 74 is formed in a flat hexahedral shape to correspond to the front end of the supporting frame 71. The gears G1, G2 and G3 are provided in the gear box 74.

The first and second ice trays 75A and 75B are supplied with water stored in the first and second water storage spaces 32A and 32B of the water tank 20, for substantially making the ices. That is, the first and second ice trays 75A and 75B receive water from the first and second water storage spaces 32A and 32B, respectively, and make the ices. As illustrated in FIG. 4, a plurality of ice making cavities 76A and 76B are formed in the first and second ice trays 75A and 75B, respectively.

The first and second ice trays 75A and 75B are formed in a flat hexahedral shape with a rectangular cross-section. The first and second ice trays 75A and 75B are installed inside the supporting frame 71 so that both short side direction faces thereof can face the front and rear ends of the supporting frame 71, respectively. For convenience of explanation, both short side direction faces of the first and second ice trays 75A and 75B facing the front and rear ends of the supporting frame 71 are referred to as the front and rear faces, and both long side direction faces of the first and second ice trays 75A and 75B facing both side ends of the supporting frame 71 are referred to as both sides. Rotation connection portions 78A and 78B and rotation axes 77A and 77B are provided at the front and rear faces of the first and second ice trays 75A and 75B, respectively. Substantially, the rotation connection portions 78A and 78B and the rotation axes 77A and 77B become the rotation centers of the first and second ice trays 75A and 75B. The rotation connection portions 78A and 78B extend into the gear box 74 through the rear face of the gear box 74. The rotation axes 77A and 77B are rotatably supported at the rear end of the supporting frame 71.

Connection bars 79A and 79B are formed at the front faces of the first and second ice trays 75A and 75B, respectively. While the first and second ice trays 75A and 75B are twisted, the connection bars 79A and 79B transfer the twisting moment to the edge portions thereof relatively spaced apart from the rotation axes 77A and 77B for efficient twisting. The connection bars 79A and 79B are formed in a shape, so that both ends thereof are fixed to one ends of the front faces of the first and second ice trays 75A and 75B and one sides of the rotation connection portions 78A and 78B, respectively. In this embodiment, the connection bars 79A and 79B and the tray stoppers 72A and 72B are symmetric around imaginary lines of connecting the rotation connection portions 78A and 78B to the rotation axes 77A and 77B. That is, as seen in the drawing, when the tray stoppers 72A and 72B support the rear right ends of the first and second ice trays 75A and 75B, the connection bars 79A and 79B connect the front left ends of the first and second ice trays 75A and 75B to the rotation connection portions 78A and 78B, respectively.

The user can hold and rotate the operation lever L to rotate and twist the first and second ice trays 75A and 75B. The operation lever L is rotatably installed at the front center portion of the gear box 74. In this embodiment, the first and second ice trays 75A and 75B are simultaneously rotated by the operation of the operation lever L. Alternatively, two operation levers can be provided to rotate the first and second ice trays 75A and 75B, respectively.

The gears G1, G2 and G3 are composed of one driving gear G1 and a pair of driven gears G2 and G3. The driving gear G1 is connected to the operation lever L to rotate in the same direction as the rotation direction of the operation lever L. The driven gears G2 and G3 are connected to the rotation connection portions 78A and 78B, respectively, and engaged with the driving gear G1. Accordingly, when the operation lever L is rotated, the driving gear G1 is rotated, and thus the driven gears G2 and G3 are rotated in the same direction.

Although not illustrated, in a state where the first and second ice trays 75A and 75B are rotated and twisted to separate the ices, an elastic member is provided to apply an elastic force to rotate the first and second ice trays 75A and 75B, so that the first and second ice trays 75A and 75B can return to the initial positions supported by the tray stoppers 72A and 72B in the horizontal level. For example, a torsion spring with both ends supported by one side of the supporting frame 71 and the first ice tray 75A or the second ice tray 75B can be provided at the rotation axes 77A and 77B.

The ice bank 80 is installed at the lower portion of the ice making space 11 under the ice making unit 70 to be taken in and out. The ice bank 80 is formed in a flat hexahedral shape with an open top face. An ice storage space 81 for storing the ices made in the first and second ice trays 75A and 75B is defined in the ice bank 80.

The guide plate 90 is installed at the lower portion of the ice making space 11 to be taken in and out. The guide plate 90 serves to guide in and out of the ice bank 80. The guide plate 90 includes both sides and a bottom face corresponding to both sides and the bottom face of the ice bank 80 to have a vertical section of almost a '[' shape. In a state where the ice bank 80 is seated in the guide plate 90, the guide plate 90 is taken in and out of the ice making space 11. Guide protrusions 91 are formed at both sides of the guide plate 90. In a state where the guide protrusions 91 are inserted into the guide slots 17, when the guide plate 90 and the ice bank 80 seated therein are taken in and out in the forward-backward direction of the ice making space 11, the guide protrusions 91 move along the guide slots 17.

Although not illustrated, cooperation protrusions and cooperation grooves are provided to take in and out the ice bank 80 in the forward-backward direction of the ice making space 11 in cooperation with in and out of the guide plate 90. The cooperation protrusions and the cooperation grooves are formed at the bottom face of the ice bank 80 and the corresponding bottom face of the guide plate 90, respectively. One of the cooperation protrusions and the cooperation grooves is fitted into/onto the other, for taking the ice bank 80 and the guide plate 90 in and out of the ice making space 11 at the same time.

The process of making the ices in the preferred embodiment of the water tank for the refrigerator and the ice making device having the same according to the present invention will be described in detail with reference to the accompanying drawings.

Figure 6:
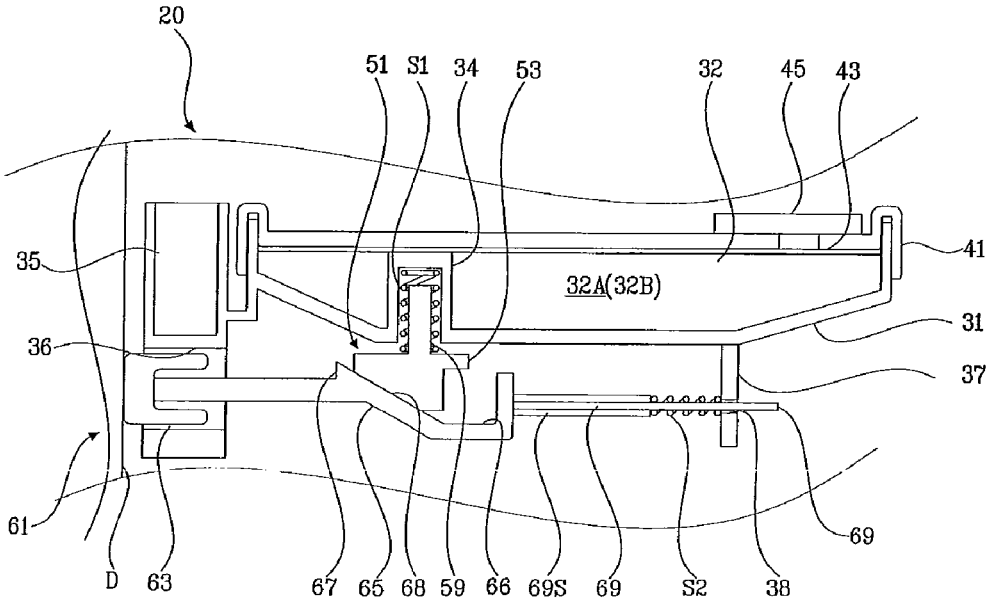
Figure 7:
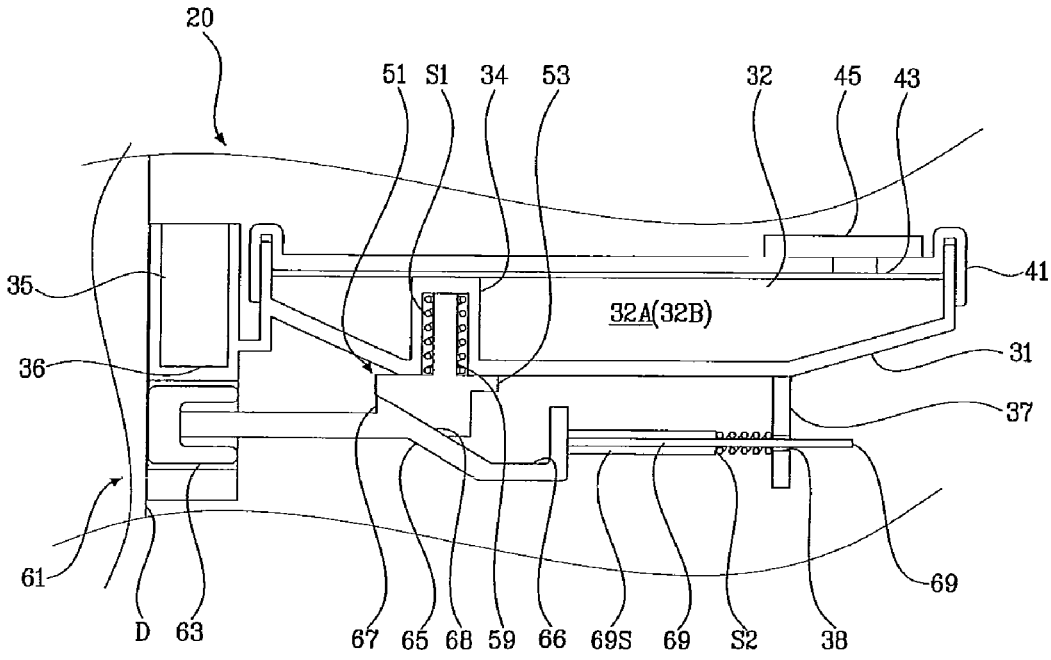
Figure 8:
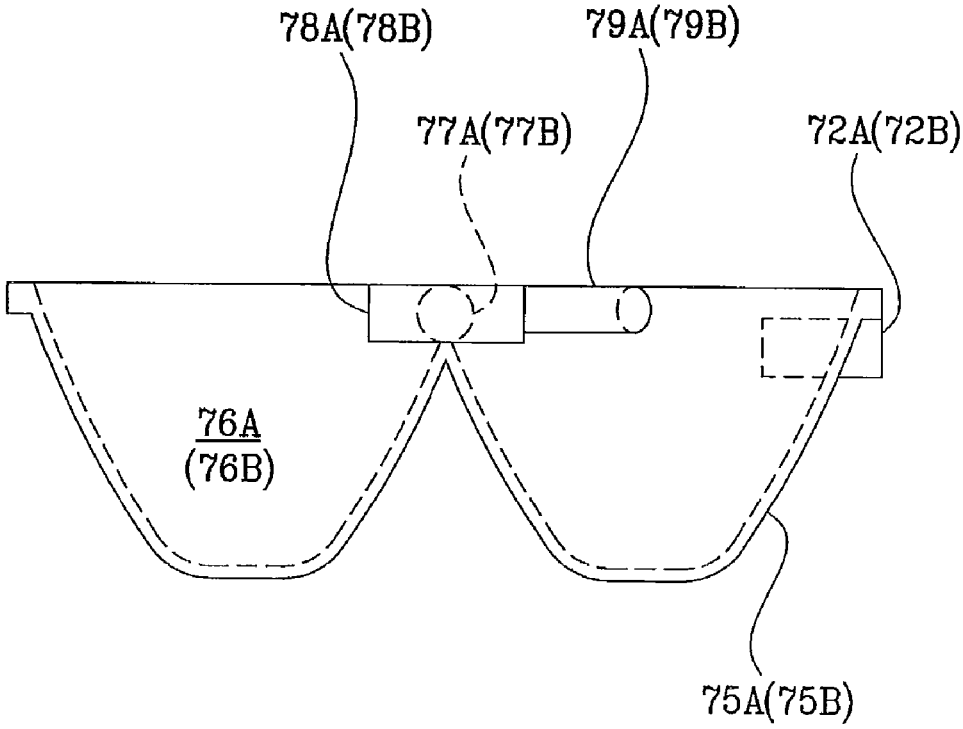
FIGS. 8 to 10 are operation state views illustrating a process of separating ices made in the ice making unit constituting the preferred embodiment of the water tank for the refrigerator and the ice making device having the same according to the present invention.
Figure 9:
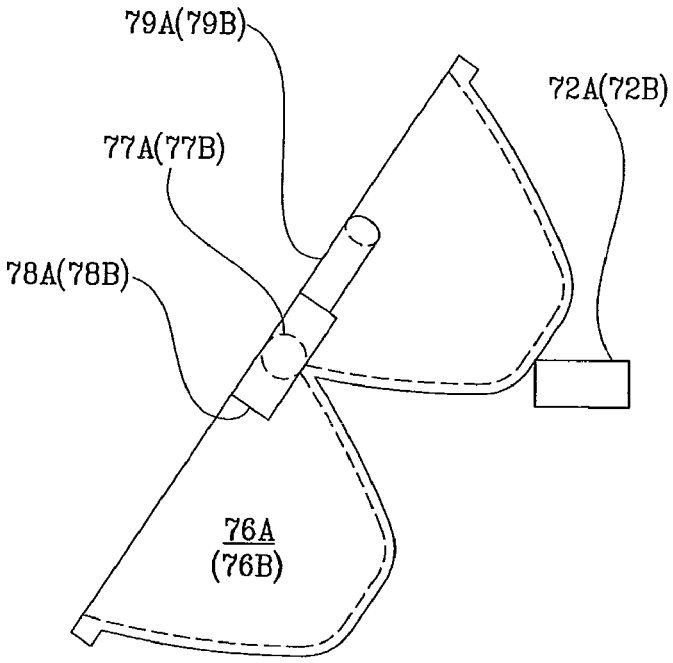
Figure 10:
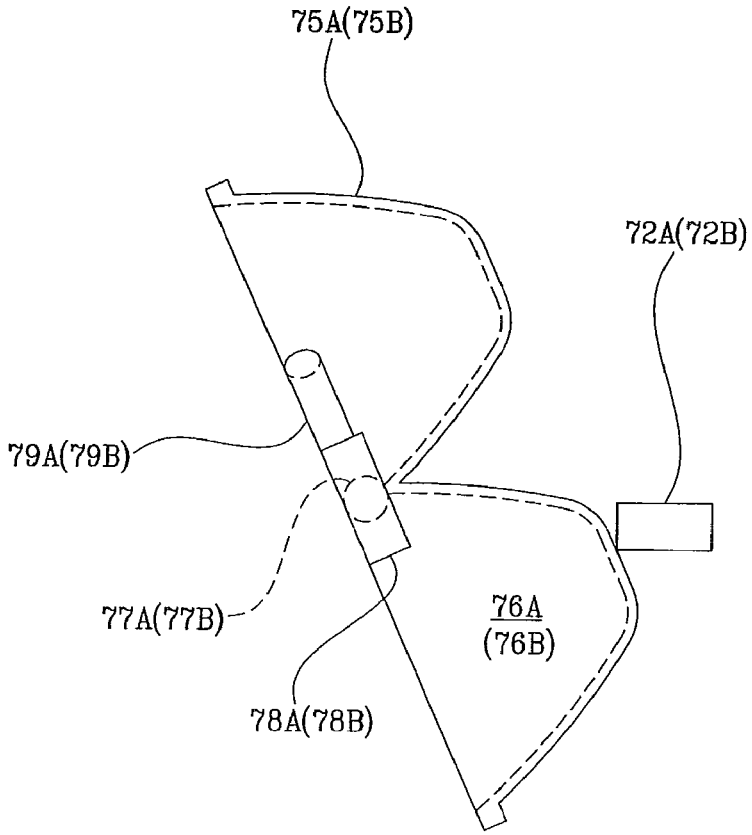

FIGS. 5 to 7 are operation state views illustrating a process of supplying water stored in the water tank constituting the preferred embodiment of the water tank for the refrigerator and the ice making device having the same according to the present invention, and FIGS. 8 to 10 are operation state views illustrating a process of separating the ices made in the ice making unit constituting the preferred embodiment of the water tank for the refrigerator and the ice making device having the same according to the present invention.

Referring to FIG. 5, in a state where the water tank 20 is mounted in the ice making space 11, the first and second water supply holes 33A and 33B are shielded by the valve caps 57A and 57B. Here, the valve 51 and the valve driving button 61 are applied with the elastic force from the first and second coil springs S1 and S2 to move to the lower part or the front, so that the first and second water supply holes 33A and 33B can be continuously shielded by the valve caps 57A and 57B. Therefore, water stored in the first and second water storage spaces 32A and 32B is not externally leaked by arbitrary opening of the first and second water supply holes 33A and 33B.

Meanwhile, in a state where the water tank 20 is mounted in the ice making space 11, when the user shields the freezing chamber by closing the freezing chamber door D, as shown in FIG. 6, the valve driving button 61, substantially, the operation portion 63 of the valve driving button 61 is pressed by the freezing chamber door D. The valve driving button 61 pressed by the freezing chamber door D moves to the rear with regard to the water tank 20. When the valve driving button 61 moves to the rear, the valve 51 moves to the upper part by the driving protrusion 67 of the driving portion 65. Accordingly, the first and second water supply holes 33A and 33B shielded by the valve caps 57A and 57B start to be open. Here, the operation portion 63 and the guide bar 69 move to the rear through the button installation opening 36 and the button guide hole 38, respectively. In addition, the first and second coil springs S1 and S2 start to be compressed by the valve 51 and the valve driving button 61 moving to the upper part or the rear, respectively.

When the freezing chamber door D completely shields the freezing chamber, as illustrated in FIG. 7, the driving portion 65 of the valve driving button 61 continuously moves to the rear and the valve 51 moves to the upper part, so that the first and second water supply holes 33A and 33B are completely open. Thus, water stored in the first and second water storage spaces 32A and 32B is supplied to the first and second ice trays 75A and 75B through the first and second water supply holes 33A and 33B. In this state, the first and second coil springs S1 and S2 are maximally compressed.

In this embodiment, the valve driving button 61 is operated by the freezing chamber door D for opening and closing the freezing chamber. Alternatively, the user can drive the valve 51 by operating the valve driving button 61. That is, in a state where the water tank 20 is mounted in the ice making space 11, the user can drive the valve 51 by directly pressing the operation portion 63.

In the meantime, after water stored in the first and second water storage spaces 32A and 32B is completely supplied to the first and second ice trays 75A and 75B, in order to re-supply water to the first and second water storage spaces 32A and 32B, the user opens the freezing chamber by opening the freezing chamber door D. At the same time, the valve 51 and the valve driving button 61 move to the lower part or the front due to the elastic force of the first and second coil springs S1 and S2, respectively, so that the first and second water supply holes 33A and 33B are shielded by the valve caps 57A and 57B, respectively. In a state where the first and second water supply holes 33A and 33B are shielded, the user takes the water tank 20 out of the ice making space 11, separates the cover 41, and supplies water to the first and second water storage spaces 32A and 32B, or opens the water supply hole 43 by rotating the water supply hole cover 45, and supplies water to the first and second water storage spaces 32A and 32B through the water supply hole 43.

As depicted in FIG. 8, water stored in the first and second water storage spaces 32A and 32B is supplied to the ice making cavities 76A and 76B of the first and second ice trays 75A and 75B through the first and second water supply holes 33A and 33B. Water filled in the ice making cavities 76A and 76B is frozen into ices by the cool air circulating in the freezing chamber. The cool air circulating in the freezing chamber is transferred to the ice making space 11 through the cool air supply holes 13.

After the ice making is finished, the user separates the ices made in the first and second ice trays 75A and 75B by rotating the operation lever L. That is, as shown in FIG. 9, when the user rotates the operation lever L, the driving gear G1 is rotated. When the driving gear G1 is rotated, the pair of driven gears G2 and G3 engaged with the driving gear G1 are rotated, so that the first and second ice trays 75A and 75B are rotated around the rotation connection portions 78A and 78B and the rotation axes 77A and 77B.

As illustrated in FIG. 10, when the first and second ice trays 75A and 75B are continuously rotated, one sides of the first and second ice trays 75A and 75R are closely adhered to the tray stoppers 72A and 72B, respectively. In this state, when the user continuously rotates the operation lever L, the first and second ice trays 75A and 75B are twisted to separate the ices. As the twisting moment is applied to the edges of the first and second ice trays 75A and 75B by the connection bars 79A and 79B, the ices can be normally separated.

When the force of rotating and twisting the first and second ice trays 75A and 75B, namely, the force of rotating the operation lever L is removed, the first and second ice trays 75A and 75B return to the initial positions due to the elastic force of the torsion spring, so that one sides of the first and second ice trays 75A and 75B are supported by the tray stoppers 72A and 72B in the horizontal level.

The ices separated from the first and second ice trays 75A and 75B are stored in the ice storage space 81 of the ice bank 80. The user can take the ice bank 80 out of the ice making space 11 and use the ices stored in the ice storage space 81. When the ice bank 80 is taken out, it is guided by the guide plate 90. That is, in a state where the ice bank 80 is seated in the guide plate 90, the ice bank 80 is taken out in cooperation with the taken-out operation of the guide plate 90. In a state where the ice bank 80 and the guide plate 90 are taken out of the ice making space 11, the user lifts the ice bank 80 from the guide plate 90, and takes out the ices stored in the ice storage space 81.

Figure 11:
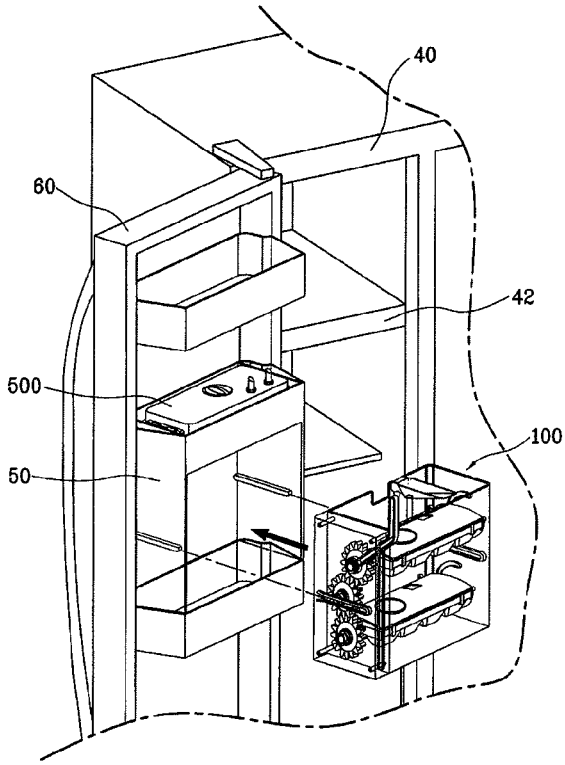
FIG. 11 is a view illustrating a refrigerator according to another embodiment of the present invention.

FIG. 11 is a view illustrating a refrigerator according to another embodiment of the present invention. The refrigerator includes a storage chamber 40 for defining a storage space for food or the like, low temperature cool air being circulated therein, and a door 60 installed at the storage chamber 40, for opening and closing the storage chamber 40. In this embodiment, an ice tray assembly for a refrigerator is installed at the door 60. The ice tray assembly for the refrigerator includes an outer casing 50, an inner casing 100, and a water tank 500. The outer casing 50 is mounted at the door 60, and the inner casing 100 is inserted into the outer casing 50. The water tank 500 is provided at the upper portion of the outer casing 50, for supplying water to the inner casing 100.

In addition, the storage space defined by the storage chamber 40 is partitioned off by a shelf. In this embodiment, a dike 42 is installed in the storage chamber 40 as the shelf for partitioning off the storage space. When the door 60 is closed, the dike 42 is positioned at the upper portion of the water tank 500.

Figure 12:
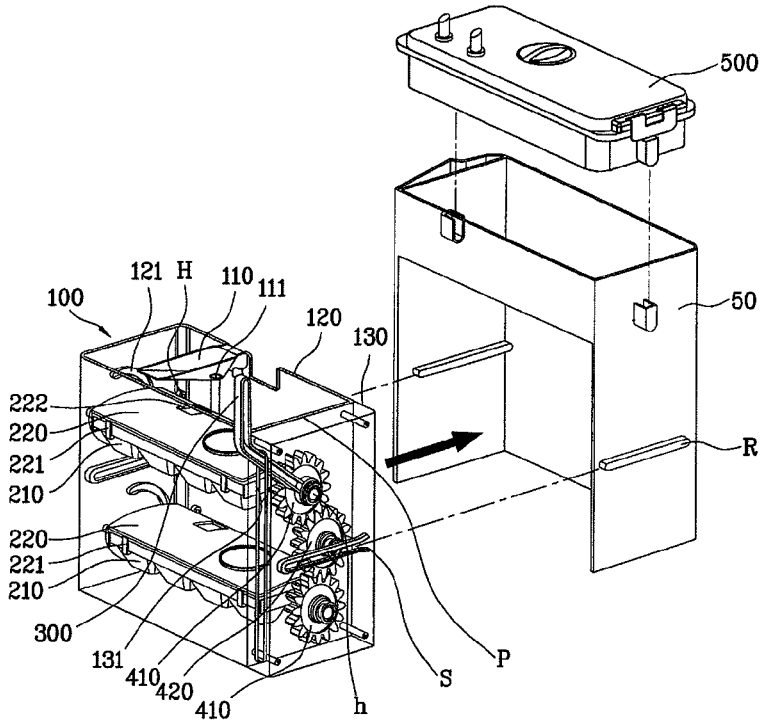
FIG. 12 is a view illustrating an ice tray assembly provided in the refrigerator according to another embodiment of the present invention.

FIG. 12 is a view illustrating an ice tray assembly provided in the refrigerator according to another embodiment of the present invention. The ice tray assembly for the refrigerator includes an outer casing 50, an inner casing 100, an ice tray 210, a rotation lever 300, a rotation gear 410, a connection gear 420, and a water tank 500.

In this embodiment, preferably, the outer casing 50 is formed in a hexahedral shape with a long up-down length so that the inner casing 100 can be detachably inserted thereto and that the plurality of ice trays 210 can be arranged therein in the up-down direction. In this embodiment, one face of the outer casing 50 corresponds to the inner face of the refrigerator door 60 (refer to FIG. 11) so that the outer casing 50 can be mounted at the refrigerator door 60 (refer to FIG. 11). As the ice tray assembly can be mounted at the refrigerator door 60 (refer to FIG. 11), the ice tray assembly occupies a minimum mounting space in the refrigerator. Moreover, in this embodiment, the other face of the outer casing 50 is open so that the inner casing 100 can be taken in and out.

In addition, a rib R which is an insertion guide member is provided at the outer casing 50. In this embodiment, the rib R protrudes from the inner face of the outer casing 50 in the insertion direction of the inner casing 100. In order to stably take in and out the inner casing 100, the ribs R are preferably formed at both inner faces of the outer casing 50.

The inner casing 100 is inserted into the outer casing 50 to be separable from the outer casing 50. In this embodiment, preferably, the inner casing 100 is formed in a hexahedral shape with a long up-down length to be inserted into the outer casing 50 and to accommodate the plurality of ice trays 210 arranged in the up-down direction. Preferably, the bottom face of the inner casing 100 is open so that the ices dropped from the plurality of ice trays 210 can pass therethrough, and one or more sides thereof are made of a transparent material so that the user can see the ices made in the plurality of ice trays 210 through the inner casing 100.

In more detail, in this embodiment, the inner casing 100 includes a water supply path 110, an ice making portion 120, and an operation portion 130. The ice making portion 120 and the operation portion 130 are successively arranged from the rear face of the inner casing 100. A partition P for separating the ice making portion 120 from the operation portion 130 is provided in the inner casing 100. In addition, holes h fitted onto the rotation gear 410 and the connection gear 420 are formed at the inner casing 100. Here, the holes h are formed at the partition P for separating the ice making portion 120 from the operation portion 130.

In this embodiment, the water supply path 110 is formed in the inner casing 100, for supplying water discharged from the water tank 500 to any one of the plurality of ice trays 210. The water supply path 110 is formed in a funnel shape to collect water from the water tank 500 and supply water to the ice tray 210 positioned at the lower portion of the inner casing 100 among the plurality of ice trays 210. The water supply path 110 includes a tube 111 positioned at the upper portion of the ice tray 210 positioned at the lower portion of the inner casing 100 among the plurality of ice trays 210 in order to supply water to the ice tray 210 positioned at the lower portion of the inner casing 100 among the plurality of ice trays 210.

A lever hole 131 is formed at the operation portion 130 to be long in the up-down direction so that the rotation lever 300 can pass therethrough.

A slot S which is an insertion guide member is formed at the inner casing 100. In this embodiment, the slot S is formed at the outer face of the operation portion 130 in the insertion direction of the inner casing 100, so that the rib R formed at the outer casing 50 is fitted thereto. Accordingly, the outer casing 50 and the inner casing 100 can be stably connected and disconnected. Further, a groove 121 for restricting the rotation angle of the ice tray 210 is formed at the inner casing 100. In this embodiment, the groove 121 is formed at one face of the ice making portion 120.

The ice trays 210 are filled with water to make ices. In this embodiment, each of the ice trays 210 includes a cover 220 for preventing leakage of water or ice from the ice tray 210 and improving the sanitation, A water supply hole 222 is formed at the cover 220 so that water can be downwardly supplied to the ice tray 210.

In addition, in order to prevent leakage of water or ice from the ice tray 210 due to opening and closing of the refrigerator door 60 (refer to FIG. 11) after water supply, the cover 220 includes a hook 221 unhooked to take out the ices. Preferably, the inner casing 100 includes a rod (not shown) for opening the cover 220 of the ice tray 210, when the ice tray 210 is rotated to separate the ices.

Here, the cover 220 is hinge-coupled H to the ice tray 210 to open and close the top face of the ice tray 210. If the ice tray 210 is rotated in the clockwise direction to open the cover 220, the cover 220 is hinge-coupled H to the left side of the longitudinal axis of the ice tray 210, and if the ice tray 210 is rotated in the counterclockwise direction, the cover 220 is hinge-coupled H to the right side of the longitudinal axis of the ice tray 210. In this embodiment, as the ice tray 210 is rotated in the counterclockwise direction, the cover 220 is hinge-coupled H to the right side of the longitudinal axis of the ice tray 210. Therefore, when the ice tray 210 is rotated, the cover 220 is open, so that the ices separated from the ice tray 210 fall down.

A protrusion (not shown) inserted into the groove 121 formed at the inner casing 100 to restrict the rotation angle of the ice tray 210 is provided at the ice tray 210. Accordingly, the rotation angle of the ice tray 210 can be restricted.

In this embodiment, the plurality of ice trays 210 are arranged in the up-down direction. Each of the ice trays 210 is rotatably installed in the inner casing 100. To this end, the longitudinal axis of the ice tray 210 is preferably connected to the rotation gear 410 fitted into the hole (not shown) formed at one face of the ice making portion 120 and the hole h formed at the partition P for separating the ice making portion 120 from the operating portion 130. Preferably, the plurality of ice trays 210 are arranged to be inclined in the up-down direction not to interfere with each other, when each of the ice trays 210 is rotated to separate the ices therefrom. In this embodiment, the plurality of ice trays 210 are arranged to form slant lines from the left upper part to the right lower part on the front side of the inner casing 100.

The rotation lever 300 is connected to the ice tray 210, for rotating the ice tray 210. In this embodiment, one end of the rotation lever 300 is connected to any one of the plurality of ice trays 210, and the other end thereof protrudes to the outside of the inner casing 100 through the lever hole 131 of the operation portion 130, so that the rotation lever 300 is rotated around the longitudinal axis of any one of the ice trays 210. Preferably, in order to secure a rotation space, the rotation lever 300 is connected to the ice tray 210 placed at the upper portion of the inner casing 100. Preferably, the rotation lever 300 is rotated in the counterclockwise direction.

In this embodiment, the plurality of rotation gears 410 are connected to the plurality of ice trays 210, and engaged with each other. Preferably, the plurality of rotation gears 410 are connected to the longitudinal axes of the plurality of ice trays 210, respectively, to be rotated with the ice trays 210. Moreover, preferably, the rotation gears 410 connected respectively to the ice trays 210 have the same gear ratio to maintain the same rotation angle.

In this embodiment, the connection gear 420 connects each of the rotation gears 410 so that the plurality of ice trays 210 can be rotated in the same direction as the rotation direction of the rotation lever 300. Preferably, the connection gear 420 is positioned between the plurality of rotation gears 410 connected to the plurality of ice trays 210 in order to rotate the plurality of ice trays 210 in the same direction as the rotation direction of the rotation lever 300. Preferably, the rotation gears 410 connected respectively to the ice trays 210 have the same gear ratio to maintain the same rotation angle.

Figure 13:
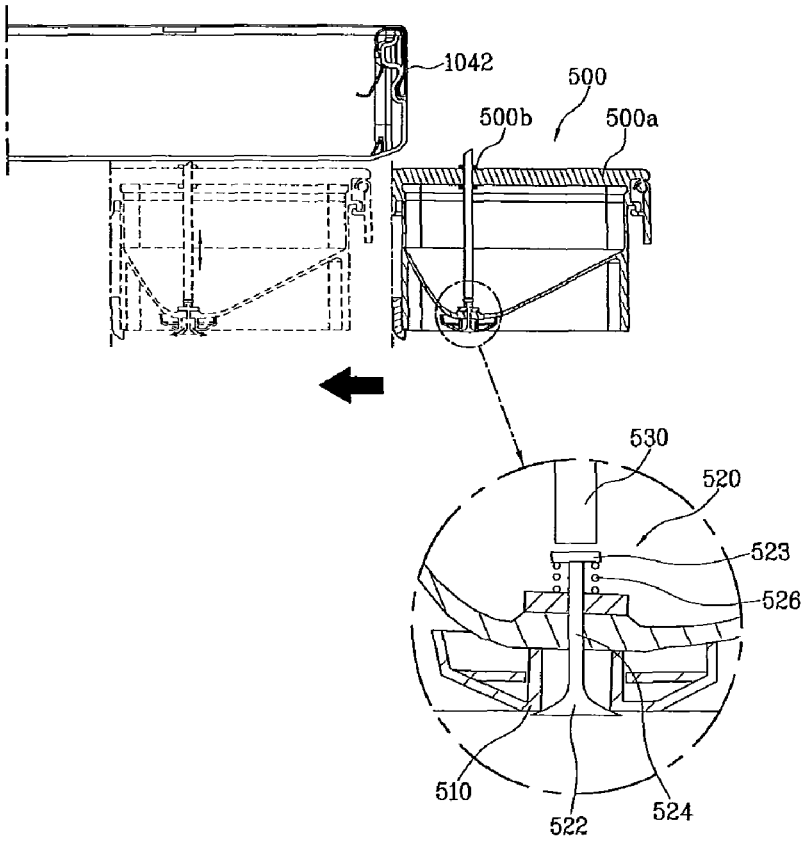
FIG. 13 is a view illustrating a state where a water tank provided in the ice tray assembly of the refrigerator according to another embodiment of the present invention is operated by closing of a door.

FIG. 13 is a view illustrating a state where the water tank provided in the ice tray assembly of the refrigerator according to another embodiment of the present invention is operated by closing of the door. The water tank 500 includes a water supply hole 510, a valve 520 and a lever 530.

In this embodiment, the water supply hole 510 is formed at the bottom face of the water tank 500, for supplying water to the ice tray 210. Here, the plurality of water supply holes 510 are formed to supply water to the plurality of ice trays 210, respectively.

The valve 520 opens the water supply hole 510 in cooperation with closing of the door 60 (refer to FIG. 11). In this embodiment, the valve 520 includes a head 522, a stem 524 and an elastic member 526. The head 522 is positioned at the bottom end of the water supply hole 510, for opening and closing the water supply hole 510. The stem 524 extends from the head 522 to the inside of the water tank 500. A protrusion portion 523 is formed at the end of the stem 524 extending to the inside of the water tank 500 so that the elastic member 526 can be fitted between the water supply hole 510 and the stem 524. In this embodiment, the elastic member 526 is implemented with a spring. Therefore, the head 522 moves in the up-down direction to open and close the water supply hole 510.

The lever 530 mediates opening of the valve 520 in cooperation with closing of the door 60 (refer to FIG. 11). In this embodiment, the lever 530 connects the protrusion portion 523 of the stem 524 to the outside of the water tank 500 in order to open the valve 520 outside the water tank 500. Here, the lever 530 passes through a lid 500*a* of the water tank 500 to protrude from the inside of the water tank 500 to the outside thereof. Preferably, a sealing portion 500*b* is formed at the lid 500*a* of the water tank 500 to seal up between the lever 530 and the lid 500*a* of the water tank 500. In addition, the sealing portion 500*b* guides the motion of the lever 530 so that the lever 530 can move in the up-down direction to open the valve 520.

In the water tank 500 with the above configuration, when the door 60 (refer to FIG. 11) is closed, the lever 530 protruding to the upper portion of the water tank 500 is pressed by the dike 42 formed in the storage chamber to open the valve 520, thereby supplying water to the ice tray 210.

Figure 14:
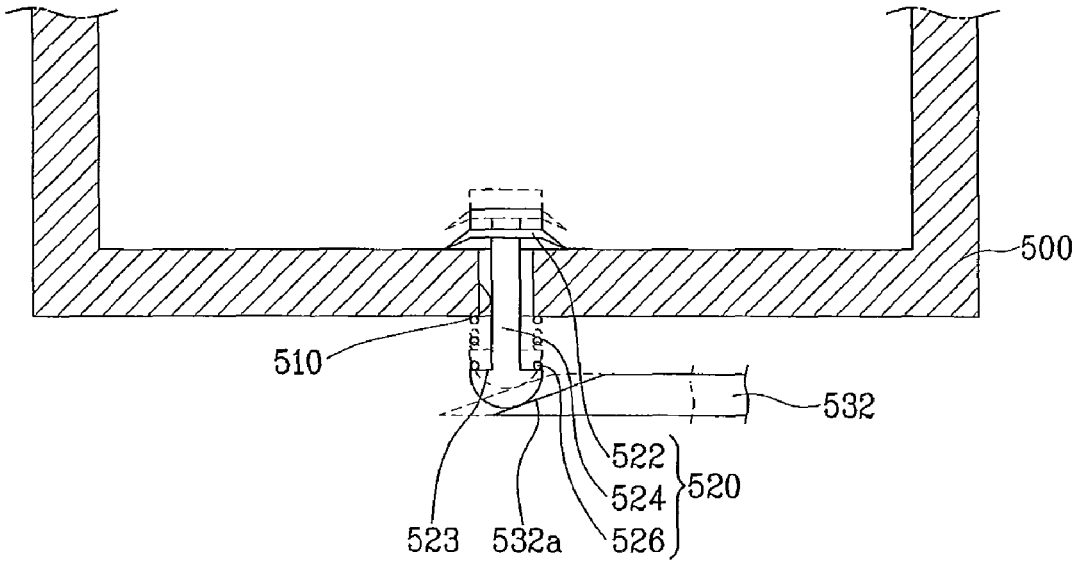
FIG. 14 is a cross-sectional view illustrating a state where the water tank provided in the refrigerator according to another embodiment of the present invention is operated by closing of the door.

FIG. 14 is a cross-sectional view illustrating a state where the water tank provided in the refrigerator according to another embodiment of the present invention is operated by closing of the door.

The valve 520 opens the water supply hole 510 in cooperation with closing of the door 60 (refer to FIG. 11). In this embodiment, the valve 520 includes the head 522, the stem 524 and the elastic member 526. The head 522 is positioned at the upper portion of the water supply hole 510, for opening and closing the water supply hole 510. The stem 524 extends from the head 522 to the outside of the water tank 500. The protrusion portion 523 is formed at the end of the stem 524 extending to the outside of the water tank 500 so that the elastic member 526 can be fitted between the water supply hole 510 and the stem 524. In this embodiment, the elastic member 526 is implemented with a spring. Accordingly, the head 522 moves in the up-down direction to open and close the water supply hole 510.

Figure 15:
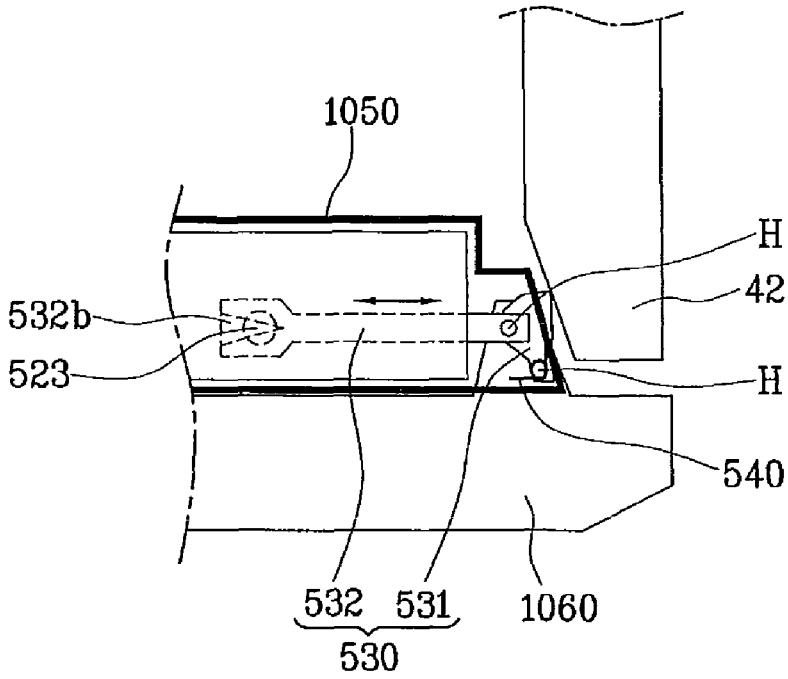
FIGS. 15 and 16 are plane views illustrating states where the water tank provided in the refrigerator according to another embodiment of the present invention is operated by closing of the door.
Figure 16:
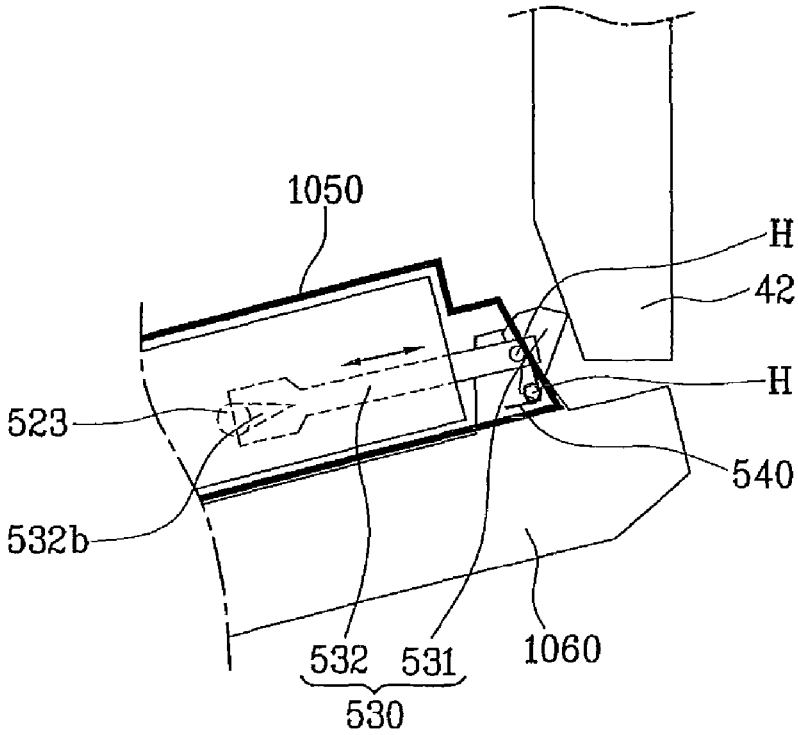

FIGS. 15 and 16 are plane views illustrating states where the water tank provided in the refrigerator according to another embodiment of the present invention is operated by closing of the door. The lever 530 is provided at the door 60 or the casing 50 to mediate the operations of the dike 42 constituting the inner sidewall of the storage chamber 40 (refer to FIG. 11) and the valve 520. In this embodiment, the lever 530 connects the protrusion portion 523 formed at one end of the stem 524 (refer to FIG. 14) to the dike 42, and is pivotably installed at the casing 50. In this embodiment, the lever 530 includes a cooperation member 531 and an opening member 532.

In this embodiment, the cooperation member 531 is a plate with one side fixed to the casing 50 by a hinge H and the other side contacting the dike 42. An elastic member 540 is installed to maintain the contact between the cooperation member 531 and the dike 42. In this embodiment, the elastic member 540 is implemented with a foldable spring, and installed on the hinge H side for rotatably fixing the cooperation member 531 to the casing 50. Therefore, the cooperation member 531 moves in contact with the dike 42 by opening and closing of the door 60.

The opening member 532 has one side hinge-coupled H to the cooperation member 531, and the other side connected to the protrusion portion 523 of the stem 524 (refer to FIG. 14) of the valve 520. The opening member 532 moves by pivoting of the cooperation member 531. An inclined face 532*a* is formed at the other side of the opening member 532 connected to the protrusion portion 523 of the stem 524 (refer to FIG. 14), for moving the stem 524 (refer to FIG. 14) in the up-down direction. Accordingly, when the cooperation member 531 moves in contact with the dike 42 by opening and closing of the door 60, the opening member 532 moves to open and close the valve 520. In order to prevent the protrusion portion 523 of the stem 524 (refer to FIG. 14) from breaking away from the opening member 532, a guide groove 532*b* is formed at the other side of the opening member 532 connected to the protrusion portion 523 of the stem 524 (refer to FIG. 14). Preferably, the protrusion portion 523 is tapered to be inserted into the guide groove 532*b*, for moving the stem 524 with the movement of the opening member 532.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A refrigerator, comprising:

a cooling chamber for storing an article at a low temperature;

a main body for defining the cooling chamber;

a door for opening and closing the cooling chamber;

an ice tray positioned in the cooling chamber and fillable with water, for making ice;

a water tank with a water supply hole for storing water and supplying water to the ice tray;

a valve for selectively opening and closing the water supply hole; and an operation member for opening the valve, wherein the operation member is a valve driving button, wherein the ice tray and the water tank are positioned in the main body, and wherein the valve driving button is pressed to open the valve by closing of the door.

2. The refrigerator of claim 1, wherein the water supply hole is positioned at the lower portion of the water tank, and the valve is installed to be movable in the up-down direction through the water supply hole, the refrigerator further comprising a first elastic member for applying force to move the valve to the lower part to shield the water supply hole.

3. The refrigerator of claim 2, wherein the valve driving button is positioned at the front of the water tank, and pressed to the rear of the water tank, for moving the valve to the upper part to open the water supply hole, the refrigerator further comprising a second elastic member for applying force to move the valve driving button to the front.

4. The refrigerator of claim 1, further comprising a cover for selectively opening and closing the water tank.

5. The refrigerator of claim 4, wherein the water tank is partitioned off into a plurality of water storage spaces, and a plurality of water supply holes are formed at the plurality of water storage spaces, respectively, for supplying water to the ice tray.

6. The refrigerator of claim 4, wherein the valve comprises:

a valve main body provided at the lower portion of the water tank;

at least one cap fixing protrusion coupled to the valve main body to pass through the water supply hole; and a valve cap being provided at the leading end of the cap fixing protrusion and having a wider area than the water supply hole.

7. The refrigerator of claim 6, wherein the water tank further comprises a valve guide boss at a bottom face thereof, and the valve further comprises a supporting protrusion inserted into the valve guide boss to move along the valve guide boss in the up-down direction.

8. The refrigerator of claim 6, further comprising a first elastic member for applying an elastic force to move the valve to the lower part to shield the water supply hole.

9. The refrigerator of claim 8, wherein both ends of the first elastic member are supported by the bottom face of the water tank and the valve main body, respectively.

10. The refrigerator of claim 1, further comprising an ice bank positioned at the lower portion of the ice tray, and taken in and out of the cooling chamber, for storing the ice made in the ice tray.

11. A refrigerator, comprising:

a cooling chamber for storing an article at a low temperature;

an ice tray positioned in the cooling chamber and fillable with water, for making ice;

a water tank with a water supply hole for storing water and supplying water to the ice tray;

a valve for selectively opening and closing the water supply hole;

an operation member for opening the valve; and a cover for selectively opening and closing the water tank, wherein the operation member is a valve driving button, wherein the water tank comprises a button guide portion at a bottom face thereof, and wherein the valve driving button comprises:

an operation portion positioned at the front of the water tank to be retreatable;

a driving portion positioned at the rear end of the operation portion and closely adhered to the bottom face of the valve; and a guide bar provided at the rear end of the driving portion to be movable in the forward-backward direction through the button guide portion.

12. The refrigerator of claim 11, further comprising a second elastic member for applying an elastic force to move the valve driving button to the front to shield the water supply hole.

13. The refrigerator of claim 12, wherein both ends of the second elastic member are supported by one side of the valve driving button and one side of the button guide portion, respectively.

14. A refrigerator, comprising:

a cooling chamber for storing an article at a low temperature;

a main body for defining the cooling chamber, and a door for opening and closing the cooling chamber;

an ice tray positioned in the cooling chamber and fillable with water, for making ice;

a water tank with a water supply hole for storing water and supplying water to the ice tray;

a valve for selectively opening and closing the water supply hole; and an operation member for opening the valve, wherein the operation member opens the valve in cooperation with closing of the door.

15. The refrigerator of claim 14, wherein the operation member is a dike for opening and closing the valve.

16. The refrigerator of claim 14, comprising a lever for mediating the operations of the operation member and the valve.

17. The refrigerator of claim 14, wherein the operation member is positioned in the main body, for opening the valve in cooperation with closing of the door.

18. The refrigerator of claim 14, wherein the valve comprises:

a head positioned at the water supply hole, for opening and closing the water supply hole;

a stem extending from the head and cooperating with the operation member; and an elastic member for applying an elastic force to the stem.

19. The refrigerator of claim 14, further comprising an ice bank installed at the door, and positioned at the lower portion of the ice tray in closing of the door, for storing the ice made in the ice tray.

20. The refrigerator of claim 19, wherein the ice bank is detachably installed at the door.

21. A refrigerator, comprising:

a cooling chamber for storing an article at a low temperature;

a main body for defining the cooling chamber;

a door for opening and closing the cooling chamber;

an ice tray positioned inside the door and fillable with water, for making ice;

a water tank with a water supply hole for storing water and supplying water to the ice tray;

a valve for selectively opening and closing the water supply hole; and an operation member for opening the valve in cooperation with closing of the door.

22. The refrigerator of claim 21, wherein the operation member is a dike provided on the side of the main body, for opening the valve.

23. The refrigerator of claim 21, comprising a lever for mediating the operations of the operation member and the valve.

24. The refrigerator of claim 21, wherein the valve comprises:

a head positioned at the water supply hole, for opening and closing the water supply hole;

a stem extending from the head and cooperating with the operation member; and an elastic member for applying an elastic force to the stem.

25. The refrigerator of claim 21, further comprising an ice bank positioned at the lower portion of the ice tray in closing of the door, and taken in and out of the cooling chamber, for storing the ice made in the ice tray.

26. The refrigerator of claim 25, wherein the ice bank is installed at the door.

27. The refrigerator of claim 26, wherein the ice bank is detachable from the door.

28. A refrigerator, comprising:

a cooling chamber for storing an article at a low temperature;

a door for opening and closing the cooling chamber;

an ice tray assembly positioned in the cooling chamber or the door;

a plurality of ice trays arranged in a vertical direction in the ice tray assembly and fillable with water, for making ice;

a water tank with a water supply hole for storing water and supplying water to the plurality of ice trays;

a valve for selectively opening and closing the water supply hole; and an operation member for opening the valve in cooperation with closing of the door.

* * * * *